US011377937B2

(12) United States Patent
Hrametz et al.

(10) Patent No.: US 11,377,937 B2
(45) Date of Patent: Jul. 5, 2022

(54) SYSTEM, METHOD, AND DEVICE FOR MONITORING A PARAMETER DOWNHOLE

(71) Applicant: Halliburton Energy Services, Inc., Houston, TX (US)

(72) Inventors: Andrew Albert Hrametz, Rosenberg, TX (US); Rachel Zhou, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 881 days.

(21) Appl. No.: 16/070,122

(22) PCT Filed: Apr. 19, 2017

(86) PCT No.: PCT/US2017/028425
§ 371 (c)(1),
(2) Date: Jul. 13, 2018

(87) PCT Pub. No.: WO2018/194596
PCT Pub. Date: Oct. 25, 2018

(65) Prior Publication Data
US 2021/0215023 A1 Jul. 15, 2021

(51) Int. Cl.
*E21B 43/11* (2006.01)
*E21B 47/06* (2012.01)
(Continued)

(52) U.S. Cl.
CPC ..... *E21B 43/119* (2013.01); *E21B 47/06* (2013.01); *E21B 49/00* (2013.01)

(58) Field of Classification Search
CPC ..... E21B 43/11; E21B 49/00; E21B 49/006; E21B 49/02; E21B 47/26; E21B 47/00; E21B 47/007; E21B 49/04
See application file for complete search history.

(56) References Cited

U.S. PATENT DOCUMENTS 4,893,286 A * 1/1990 Cobb ..... G01S 15/06 367/87
4,912,683 A * 3/1990 Katahara ..... G01B 17/02 367/25

(Continued)

FOREIGN PATENT DOCUMENTS

WO 2007056121 5/2007
WO 2012154180 11/2012

OTHER PUBLICATIONS

International Search Report and Written Opinion of PCT Application No. PCT/US2017/028425 dated Dec. 12, 2017: pp. 1-16.

*Primary Examiner* — Kenneth L Thompson
(74) *Attorney, Agent, or Firm* — K&L Gates LLP

(57) ABSTRACT

A system, method, and device for monitoring a parameter downhole. The system comprises a conveyance string locatable in the wellbore, a sensor and a recorder located on the conveyance string, and a processor in communication with the recorder. The recorder comprises a sampler in communication with the sensor, and the sampler is operable to sample the measured parameter at a sampling rate of 150 kHz to 10 MHz. The recorder also comprises an information storage device in communication with the sampler and operable to store the samples acquired by the sampler. The processor is operable to monitor the parameter based on the samples collected by the sampler.

20 Claims, 7 Drawing Sheets

(51) Int. Cl.

| | |
|---|---|
| ***E21B 49/04*** | (2006.01) |
| ***E21B 43/119*** | (2006.01) |
| ***E21B 49/00*** | (2006.01) |

(56) References Cited

U.S. PATENT DOCUMENTS

| | | | | |
|---|---|---|---|---|
| 4,953,147 | A * | 8/1990 | Cobb | G01S 15/06 367/35 |
| 5,452,761 | A * | 9/1995 | Beard | E21B 47/00 324/323 |
| 5,869,968 | A * | 2/1999 | Brooks | G01V 3/30 324/338 |
| 6,108,605 | A * | 8/2000 | Doyle | G01V 3/28 324/339 |
| 6,777,940 | B2 * | 8/2004 | Macune | G01V 3/30 324/335 |
| 6,791,330 | B2 * | 9/2004 | McCormick | G01V 3/30 324/338 |
| 7,372,777 | B2 * | 5/2008 | Hurst | B06B 1/0633 367/159 |
| 7,787,525 | B1 * | 8/2010 | Clark, Jr. | E21B 47/13 375/218 |
| 8,289,994 | B2 * | 10/2012 | Abdallah | H04L 25/38 370/465 |
| 8,985,200 | B2 | 3/2015 | Rodgers et al. | |
| 9,103,196 | B2 * | 8/2015 | Zhao | G01V 1/44 |
| 9,523,273 | B2 * | 12/2016 | Mandal | E21B 47/005 |
| 2012/0111560 | A1 | 5/2012 | Hill et al. | |
| 2014/0251602 | A1 | 9/2014 | Kenison et al. | |
| 2016/0047235 | A1 | 2/2016 | Bondarenko et al. | |
| 2017/0030186 | A1 | 2/2017 | Rodgers et al. | |

* cited by examiner

SYSTEM, METHOD, AND DEVICE FOR MONITORING A PARAMETER DOWNHOLE

BACKGROUND

This section is intended to provide background information to facilitate a better understanding of the various aspects of the described embodiments. Accordingly, it should be understood that these statements are to be read in this light and not as admissions of prior art.

A well may be completed and brought into production, in part, by running a perforating gun into the wellbore and firing the perforating gun to create perforation tunnels in the formation. The perforating gun comprises explosive charges which, when ignited, pierce any casing in the wellbore and create the perforation tunnels in the formation surrounding the wellbore. Thereafter hydrocarbons may flow from the formation into the perforation tunnels, into the wellbore, and then rise up the wellbore to be produced at the surface.

When the perforating gun is fired, very high detonation pressures (e.g., several million psi) are initially generated in the wellbore. This initial pressure is transmitted to the surrounding environment, creating strong, transient shock waves that propagate supersonically through adjacent materials (such as fluid in the wellbore and a completion string supporting the perforating gun), eventually attenuating to stress and/or pressure waves traveling at acoustic velocities. The pressure waves can cause damage to downhole equipment, generally manifested as unset packers, corkscrewed tubing, collapsed tools, burst housings, or parted guns. Moreover, the damage to downhole equipment is worsened when two or more pressure waves collide as the local stress and pressure waves are intensified.

Attempts have been made to model the effects of shock due to perforating. It would be desirable to be able to predict shock due to perforating, for example, to prevent unsetting a production packer, to prevent failure of a perforating gun body, and to otherwise prevent or at least reduce damage to various components of a perforating string. In some circumstances, shock transmitted to a packer above a perforating string can even damage equipment above the packer.

In addition, wells are being drilled deeper, perforating string lengths are getting longer, and explosive loading is increasing, all in efforts to achieve enhanced production from wells. These factors are pushing the envelope on what conventional perforating strings and downhole sensing equipment can withstand.

Shock models have not been able to predict shock effects in axial, bending and torsional directions, and to apply these shock effects to three dimensional structures, thereby predicting stresses in particular components of the perforating string. One hindrance to the development of such a shock model has been the lack of satisfactory measurements of the strains, loads, stresses, pressures, and/or accelerations, etc., produced by perforating. Such measurements can be useful in verifying a shock model and refining its output. It would be desirable to incorporate high resolution sensing, logging, monitoring, and/or control features while simultaneously providing a tool that is equipped to withstand the severity of downhole hostile environments, particularly with regards to the high acceleration and broad-band frequency spectrum generated by perforating and/or pyrotechnic shock events.

DESCRIPTION OF THE DRAWINGS

For a detailed description of the embodiments, reference will now be made to the accompanying drawings in which.

DETAILED DESCRIPTION

Figure 1:
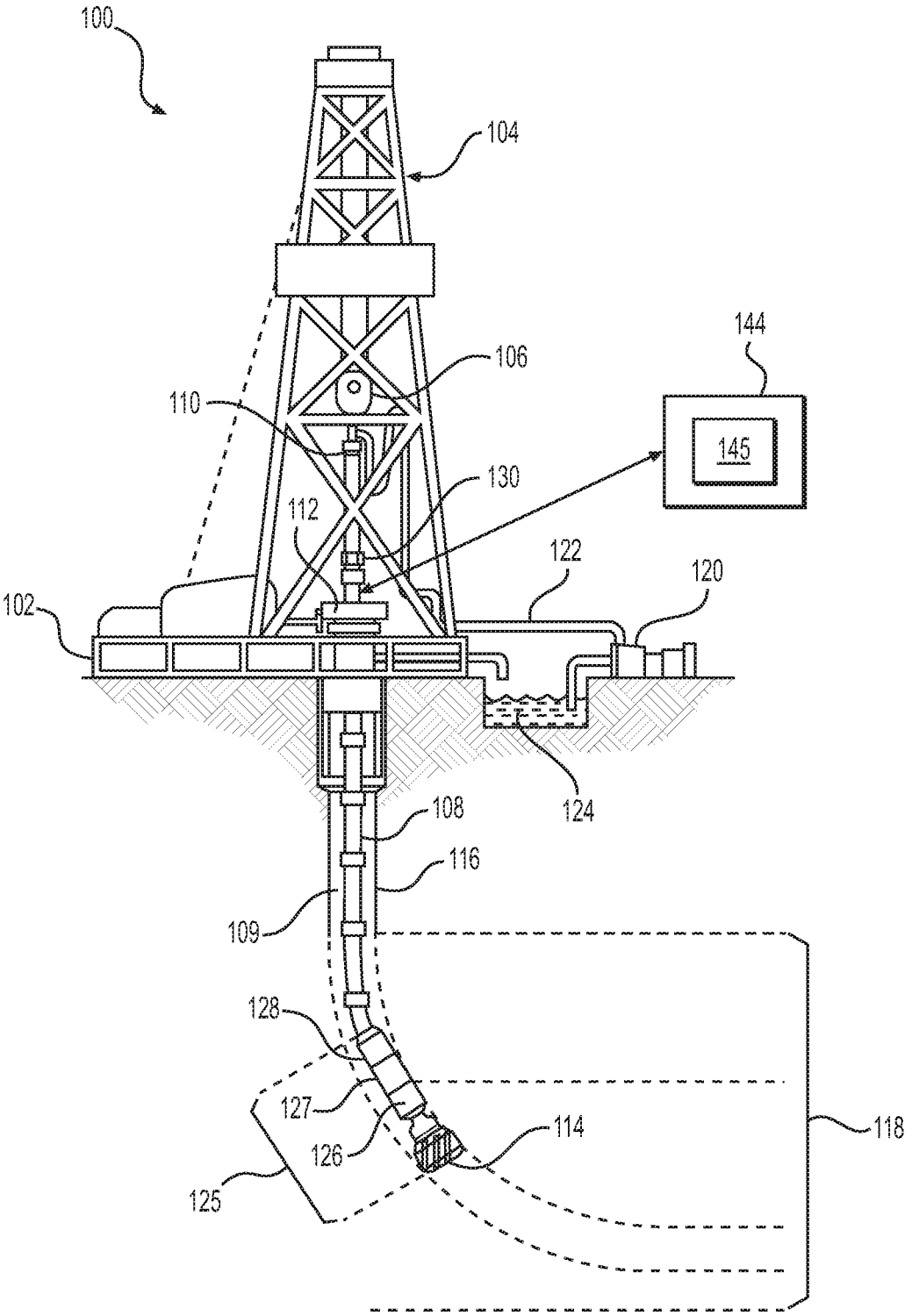
FIG. 1 shows a schematic view of a drilling environment, according to one or more embodiments.

FIG. 1 shows a schematic view a drilling operation employing a downhole sensing system 100, according to one or more embodiments. As shown, a drilling platform 102 supports a derrick 104 having a traveling block 106 for raising and lowering a drill string 108. A drill string kelly 110 supports the rest of the drill string 108 as it is lowered through a rotary table 112. The rotary table 112 rotates the drill string 108, thereby turning a drill bit 114. As the drill bit 114 rotates, it creates a wellbore 116 that passes through various subterranean earth formations 118. A pump 120 circulates drilling fluid through a feed pipe 122 to the kelly 110, downhole through the interior of the drill string 108, through orifices in the drill bit 114, back to the surface via an annulus 109 around the drill string 108, and into a retention pit 124. The drilling fluid transports cuttings from the wellbore 116 into the pit 124 and aids in maintaining the integrity of the wellbore 116.

A bottomhole assembly 125 is connected along the drill string 108 and includes drill collars 126, a downhole tool 127, and the drill bit 114. The drill collars 126 are thick-walled steel pipe sections that provide weight and rigidity for the drilling process. The downhole tool 127 (which may be built into one of the drill collars) may collect measurements relating to various wellbore and formation properties as well as the position of the bit 114 and various other drilling conditions as the bit 114 extends the wellbore 116 through the formations 118. For example, the downhole tool 127 includes a sensing device 128, in accordance with one or more embodiments of the present disclosure, to sample the measured parameter at a sampling rate greater than 150 kHz.

The downhole tool 127 may include a device for measuring formation resistivity, a gamma ray device for measuring formation gamma ray intensity, devices for measuring the inclination and azimuth of the tool string 108, pressure sensors for measuring wellbore pressure, temperature sensors for measuring wellbore temperature, etc. The downhole tool 127 may also include a telemetry device that receives data provided by the various sensors of the bottomhole assembly 125 (e.g., the sensing device 128), and transmits the data to a surface controller 144. Data may also be provided by the surface controller 144, received by the telemetry device, and transmitted to the sensors (e.g., the sensing device 128) of the bottomhole assembly 125. The surface controller 144 includes a computer system 146 for processing and storing the measurements gathered by the sensors. The computer system 146 may also be capable of controlling the bottomhole assembly 125. Among other things, the computer system 146 may include a processor and a non-transitory computer-readable medium (e.g., a hard-disk drive and/or memory) capable of executing instructions to perform such tasks.

Figure 2:
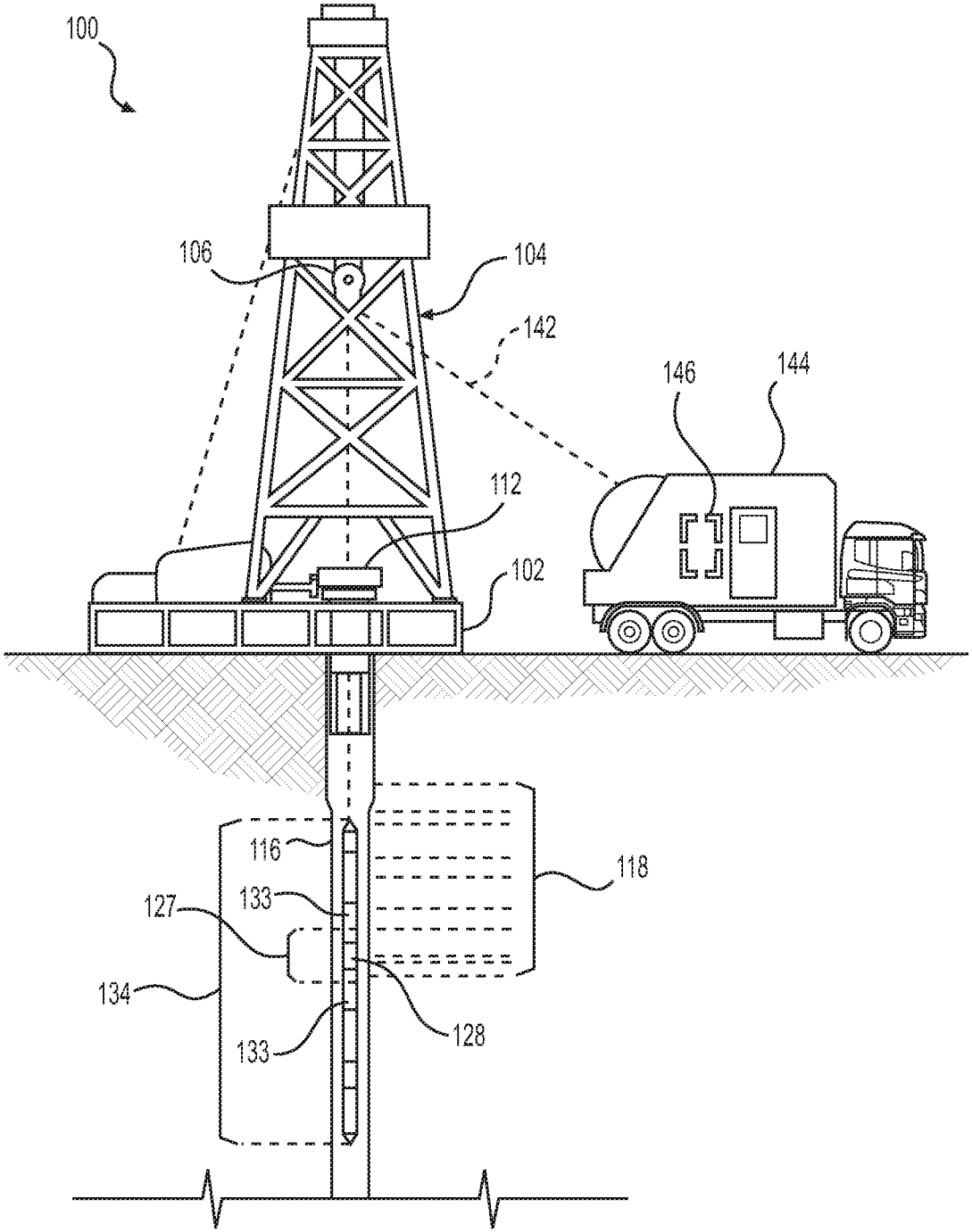
FIG. 2 shows a schematic view of a wireline logging environment, according to one or more embodiments.

FIG. 2 shows a schematic view of a wireline logging environment in which the sensing device 128, in accordance with one or more embodiments described in the present disclosure, may be used. As shown, logging operations can be conducted using a wireline logging string 134, e.g., a wireline logging sonde, suspended by a cable 142 that communicates power to the logging string 134 and telemetry signals between the logging string 134 and the surface. The logging string 134 includes the downhole tool 127, which may obtain measure parameters as described herein. For example, the sensing device 128 may sample the measured parameters as described herein.

The downhole tool 127 may be coupled to other modules of the wireline logging string 134 by one or more adaptors 133. The surface controller 144 collects measurements from the logging string 134 for processing and storing the measurements gathered by the sensors. In addition to collecting and processing measurements, the computer system 146 may be capable of controlling the logging string 134 and downhole tool 127. The surface controller 144 may further include a user interface (not shown) which displays the measurements, for example, a monitor or printer.

Figure 3:
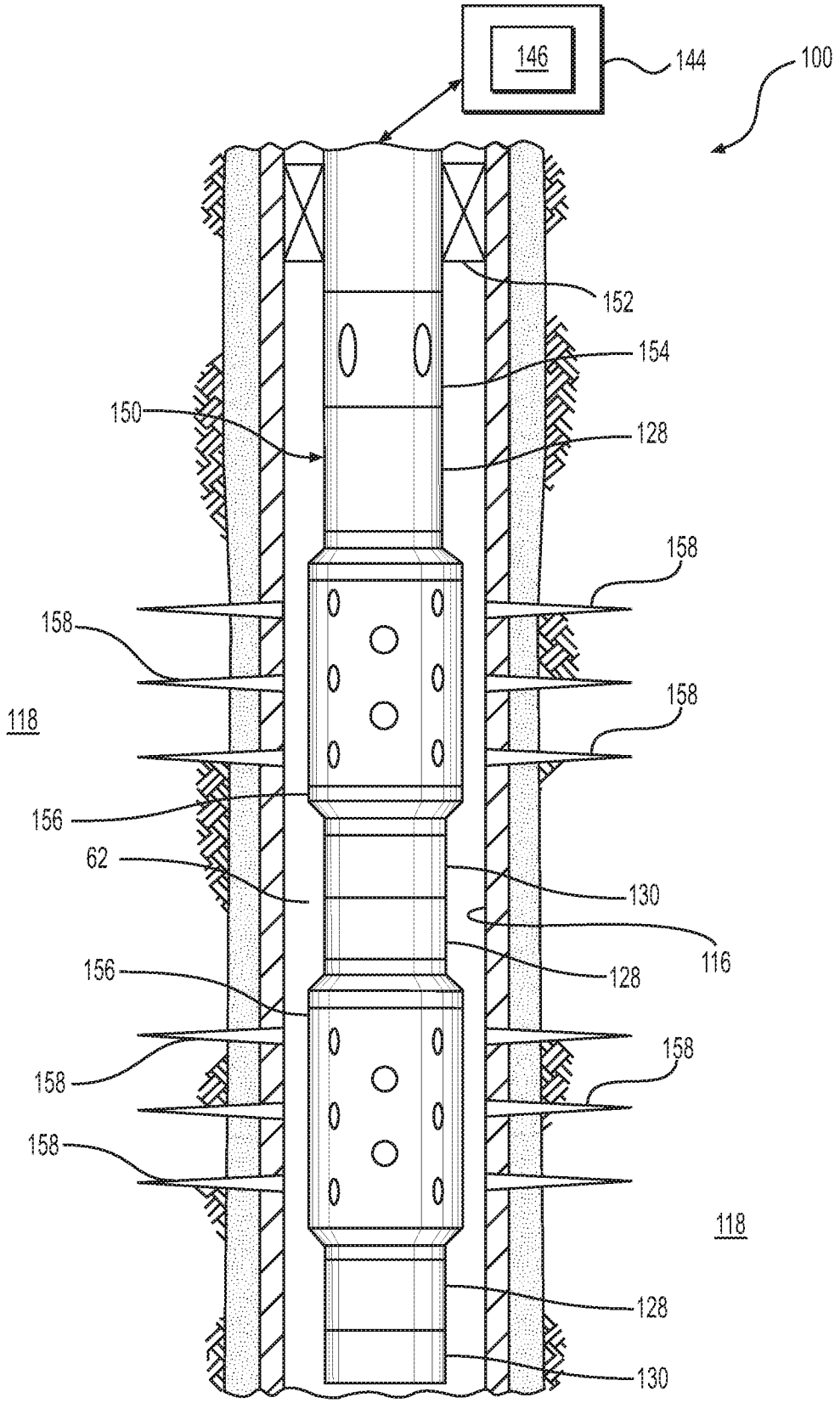
FIG. 3 shows a schematic view of a perforating environment, according to one or more embodiments.

FIG. 3 shows a schematic view of a perforating operation employing the downhole sensing system 100, in accordance with one or more embodiments. As shown, a conveyance string 150 is installed in the wellbore 116 and includes a packer 152, a firing head 154, perforating guns 156, and sensing devices 128. The conveyance string 154 may include more or less of these components. For example, well screens and/or gravel packing equipment may be provided, any number (including one) of the perforating guns 156 and sensing devices 128 may be provided, etc. As used herein, a conveyance string 150 may include a tool string, tubing string, coiled tubing, wireline, perforating string, or any other suitable conveyance device.

As shown, the sensing device 128 interconnected between the packer 152 and the upper perforating gun 156 can record the effects of perforating on the conveyance string 150 above the perforating guns. This information can be useful in preventing unsetting or other damage to the packer 152, firing head 154, etc., due to detonation of the perforating guns 156 in future designs. Interconnecting the sensing devices 128 below the packer 152 and in close proximity to the perforating guns 156 also allow more accurate measurements of strain and acceleration at the perforating guns to be obtained. Pressure and temperature sensors of the sensing devices 128 can also sense conditions in the wellbore 116 in close proximity to perforations 158 immediately after the perforations are formed, thereby facilitating more accurate analysis of characteristics of an earth formation 118 penetrated by the perforations 158.

Another sensing device 128 interconnected between perforating guns 156 can record the effects of perforating on the perforating guns themselves. This information can be useful in preventing damage to components of the perforating guns 156 in future designs.

Another sensing device 128 can be connected below the lower perforating gun 156, if desired, to record the effects of perforating at this location. In other examples, the conveyance string 150 could be stabbed into a lower completion string, connected to a bridge plug or packer at the lower end of the conveyance string, etc., in which case the information recorded by the lower sensing device 128 could be useful in preventing damage to these components in future designs.

Viewed as a complete system, the placement of the sensing devices 128 longitudinally spaced apart along the conveyance string 150 allows acquisition of data at various points in the system, which can be useful in validating a model of the system. Thus, collecting data above, between and below the guns, for example, can help in an understanding of the overall perforating event and its effects on the system as a whole. A shock model can use a three dimensional geometrical representation of the conveyance string 150 and wellbore 116 to predict the physical behavior of the well system during a perforating event. For example, the shock model can predict at least bending, torsional and axial loading, as well as motion in all directions (three dimensional motion). The model can include predictions of casing contact and friction and the loads that result from it. Detailed three dimensional finite element models of the components of the conveyance string 150 enable a higher fidelity prediction of stresses in the components. Component materials and characteristics (such as compliance, stiffness, friction, etc.), wellbore pressure dynamics, and communication with a formation can also be incorporated into the model.

The shock model may be calibrated using actual conveyance string loads and accelerations, as well as wellbore pressures, collected from one or more of the sensing devices 128. Measurements taken by the sensing devices 128 can be used to verify the predictions made by the shock model, and to make adjustments to the shock model, so that future predictions are more accurate.

The information obtained by the sensing devices 128 is not only useful for future designs, but can also be useful for current designs, for example, in post-job analysis, formation testing, etc. The applications for the information obtained by the sensing devices 128 are not limited at all to the specific examples described herein.

The sensing devices 128 may also provide real-time analysis of measurements to trigger operations in the wellbore including but not limited to regulating the dynamic pressure in the wellbore with one or more surge vents 130 during a detonation. The surge vent 130 includes a vent that is operable to open and admit wellbore fluids into a chamber and regulate the wellbore pressure. The surge vent 130 may be triggered to open and attenuate the surge of a shock front upon the sensing devices 128 detecting a detonation as further described herein.

Figure 4:
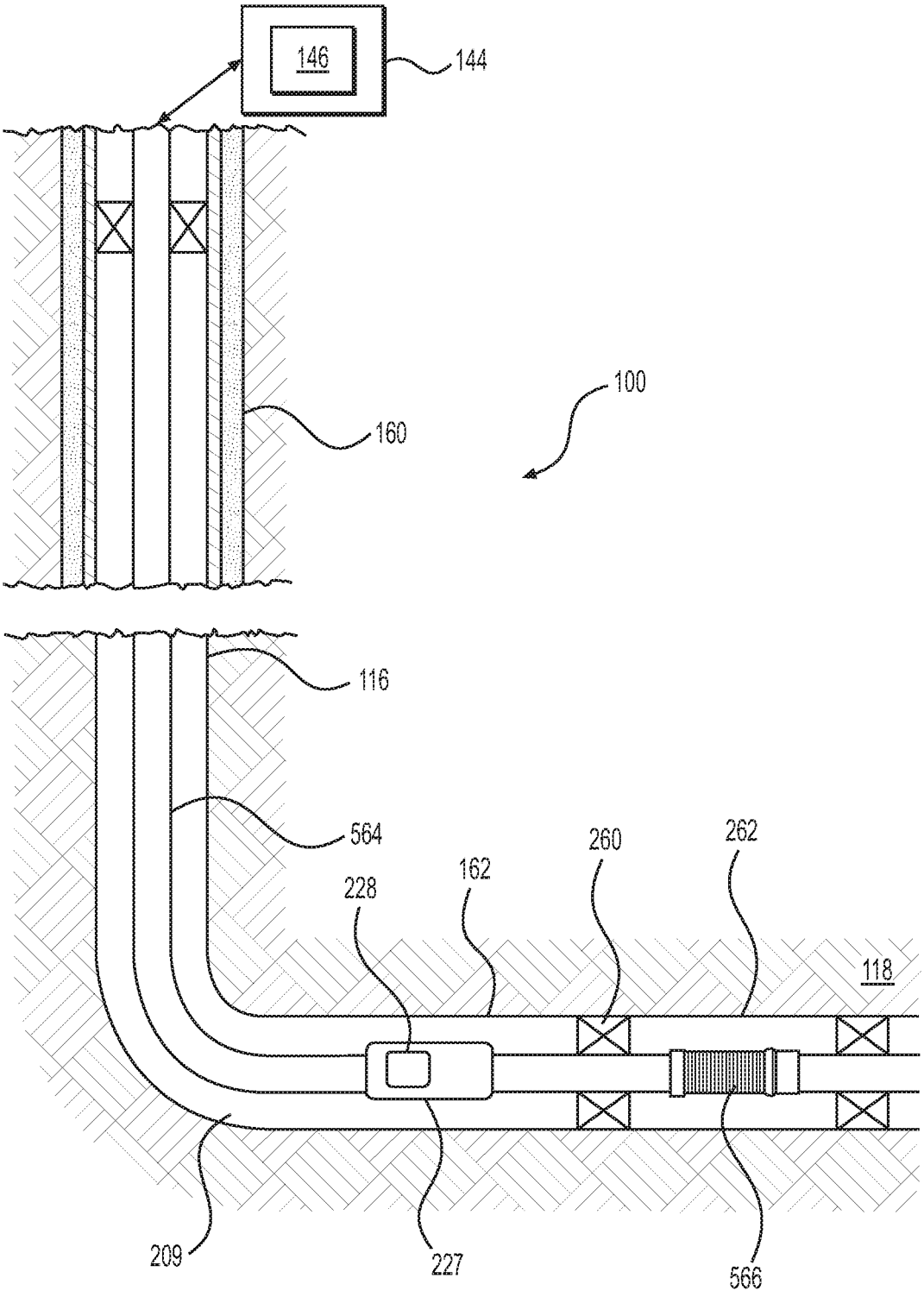
FIG. 4 shows a schematic view of a production and/or completion environment, according to one or more embodiments

FIG. 4 shows a schematic view of the sensing device 128 employed in a completion and/or production environment, in accordance with one or more embodiments. As shown, the wellbore 116 is at least partially cemented with a casing string 160 and also has an open-hole section 162. Positioned within the wellbore 116 and extending from the surface is a tubing string 164, which provides a conduit for formation fluids to travel from the formation 118 to the surface and for stimulation fluids to travel from the surface to the formation 118. The tubing string 164 includes a screen section 166, which is positioned between a pair of annular barriers depicted as packers 152 that provide a fluid seal between the tubing string 164 and the wellbore 116, thereby defining a production and/or stimulation interval 168. The screen section 166 is employed to filter particulate matter out of the production fluid stream from the formation 118 or inject stimulation fluid into the formation 118. Positioned in the wellbore 116 is the downhole tool 127, which may obtain measurements with the sensing device 128, as further described herein.

Thus, it should be clearly understood that the sensing system 100 as depicted in FIGS. 1-4 are merely some examples of a wide variety of possible downhole sensing systems which can embody the principles of this disclosure. It should also be appreciated that the sensing device 128 may be used in various applications, such as wireline, slickline, coiled tubing, MWD, LWD, perforating, completion, production, etc.

Figure 5:
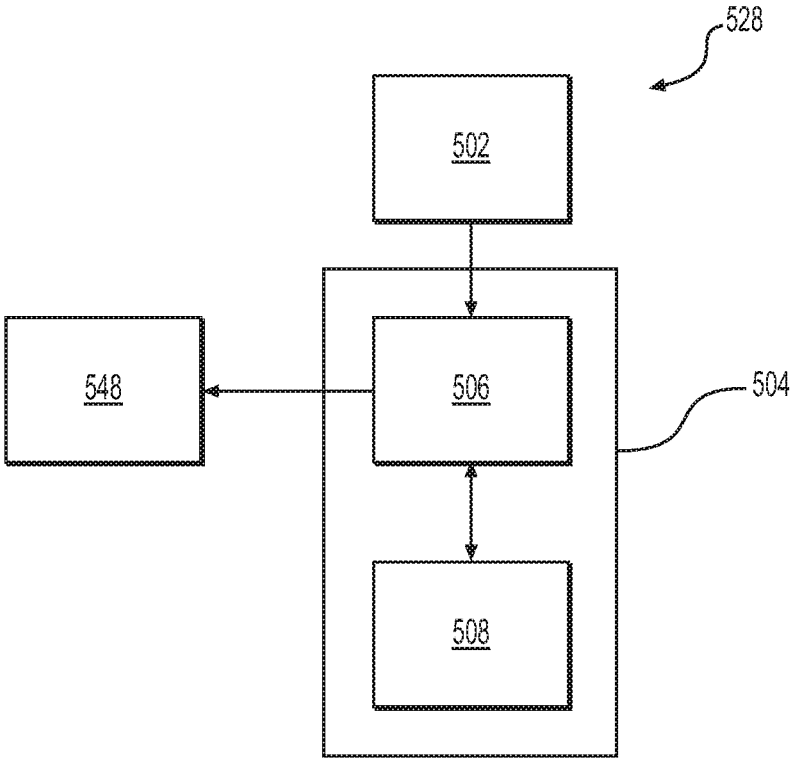
FIG. 5 shows a block diagram of a sensing device in communication with a processor, according to one or more embodiments.

FIG. 5 shows a block diagram of a sensing device 528 in communication with a processor 548, in accordance with one or more embodiments. The sensing device 528 may be located in a wellbore as depicted in FIGS. 1-4 and the processor 548 may be located in the wellbore as further described herein or at the surface included with a surface controller as depicted in FIGS. 1-4. As shown in FIG. 5, the sensing device 528 includes a sensor 502 and a recorder 504, which also comprises a sampler 506 and an information storage device 508. The sensor 502 is operable to measure a parameter downhole in the wellbore. The sensor 502 may include any one or combination of a pressure gauge, temperature sensor, load cell, strain gauge, accelerometer, and any other device suitable to measure a parameter downhole. The measured parameter may include any one or a combination of wellbore pressure, wellbore temperature, strain (e.g., hoop strain, torsional strain, or axial strain), tension, compression, and acceleration (e.g., tri-axial). For example, the sensing device 528 may sample measurements to monitor any changes in wellbore pressure, wellbore temperature, strain (e.g., hoop strain, torsional strain, or axial strain), tension, compression, and acceleration caused by a shock front of a perforating gun.

The sampler 506 is in communication with the sensor 502 and may include a digital signal processor or an analog-to-digital converter integrated with the digital signal processor. Although a single sensor 502 is illustrated in FIG. 5, the sampler 506 may have a plurality of input channels to receive measurements from multiple sensors. The input channels of the sampler 502 may be analog, digital, or a combination of analog and digital input channels. The sampler 506 may also include one or more digital or analog filters to reduce the effects of noise in the samples, including but not limited to a Butterworth filter, Chebyshev filter, discrete time filter, FIR filter, etc. Thus, the samples may be filtered by the sampler 506 before feeding the samples to the processor 548 for monitoring a condition downhole.

The sampler 506 is operable to digitally sample the measured parameter at a sampling rate greater than 150 kHz. The sampling rate of the sampler 506 may be a rate of 150 kHz to 2 MHz, 1 MHz to 2 MHz, 1 MHz to 5 MHz, 1 MHz to 10 MHz, or 150 kHz to 10 MHz or greater. In a preferred embodiment, the sampling rate of the sampler 506 may be a rate of 1 Mhz to 2 Mhz. With a sampling rate of 150 kHz to 10 MHz, the sampler 506 is also operable to sample the measured parameter such that a detonation among multiple simultaneous detonations fired from a detonation signal is identifiable in the samples. With a sampling rate of 2 MHz, the sampler 506 is at least 20 times faster than previous samplers. The sampling rate of the recorder 506 also enables the identification of the firing of individual shaped charges among multiple simultaneous firings of shaped charges as further described herein. The sampling rate of the recorder 506 may also allow for the identification of wellbore and formation properties, including but not limited to permeability, porosity, fluid conductivity.

The samples acquired by the sampler 506 can be stored in the information storage device 508 for further processing downhole or at the earth's surface, and if desired, may be used as inputs to a telemetry system (not shown) for transmitting real time data to the earth's surface for processing. The storage device 508 may include a non-transitory storage medium to electronically store the parameters generated by the sensor 502. The control and processing of the sensing device 528 may also be performed with the use of a computer program stored on the storage device 508. The non-transitory storage medium may include ROM, EPROM, EEPROM, flash memory, RAM, a hard drive, a solid state disk, an optical disk, or a combination thereof.

The sensing device 528 may have various communication modes including stand-alone memory and real-time interactive. In the stand-alone memory mode, the sensing device 528 may run on a power supply located in a wellbore as further described herein and perform various functions based on programmed instructions. Any data collected by the sensing device 528 may be retrieved once the sensing device 528 returns to the surface. In real-time interactive mode, the sensing device 528 is in communication with the processor 548 located at the surface for sending signals and data back to the surface and optionally receiving commands and feedback from the surface.

The processor 548 monitors the parameter based on the samples acquired by the sampler 506 to analyze conditions downhole. The processor 548 provides real-time digital signal tracking used to perform one or more operations, including but not limited controlling a surge vent to regulate a dynamic underbalanced pressure in the wellbore. The signal level and slope of the samples may provide a threshold to trigger a command when the samples meet the predefined levels or threshold conditions as further described herein. The threshold may be detected within two or more sampling periods of the sample rate, and the command may be transmitted immediately upon detection, providing real-time detection and response to detonations in the wellbore. For example, the processor 548 is operable to analyze the samples to determine any one or a combination of an orientation of a detonation in the wellbore, a formation response, wellbore response, and casing response to the detonation in the wellbore. The processor 548 may also be operable to analyze the samples to identify any one or a combination of deflagration, high order firing, low order firing, clean-up in a perforation, perforating gun orientation, perforating gun jump, perforating gun drop, and gas bubbles produced from a perforating gun detonation. Based on the identified event, the processor 548 may be operable to perform actions such as regulating the pressure in the wellbore with a surge vent or other suitable operations.

Figure 6:
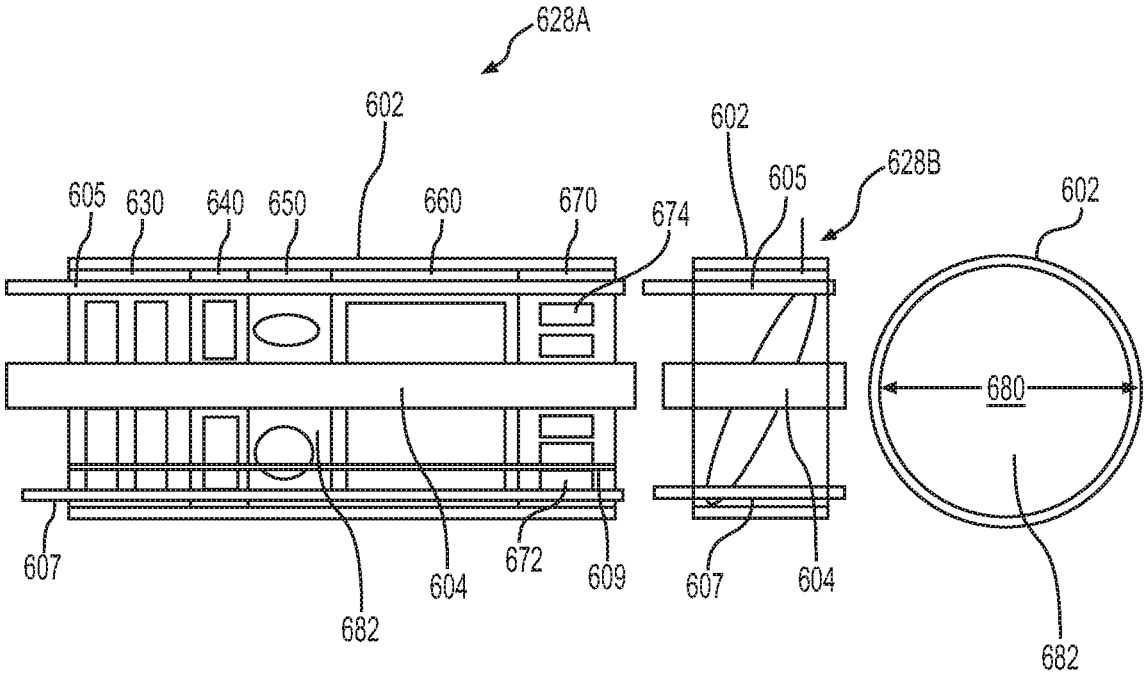
FIG. 6 shows a schematic view of sensing devices, according to one or more embodiments.

FIG. 6 shows a schematic view of sensing devices 628A and 628B, in accordance with one or more embodiments. As shown, the sensing device 628A includes one or more couplable modules 630-670, including but not limited to a power source module 630, a sensor module 640, a recorder module 650, a processor module 660, and a communication module 670. The sensing device 628B may be a self-contained module comprising any one or combination of a sensor, power supply, recorder, telemetry device, communication device, and processor as described herein with respect to the sensing device 628A. The sensing devices 628A and B also include a cylindrical housing 602 that isolates the internal components of the sensing devices 628A and B from exterior wellbore conditions. The sensing devices 628A and B may couple to a conveyance string as depicted in FIG. 3.

The versatility of the inner components of the sensing devices 628A and B allows for variations in the size of the housing 602 ranging from an outer diameter 680 of 1 11/16 inches (4.27 cm) to 7 inches (17.78 cm) to couple to a conveyance string or perforating gun as depicted in FIG. 3. The sensing devices 628A and B may include a potting material 682 to provide the various electronic components of the sensing device with a resistance to shock and vibrations, including but not limited a resistance to the shock front generated by a perforating gun. The potting material 382 may assure the survival of the sensing devices 628A and B while encountering the shock front generated by a perforating gun to increase the expected lifespan of the sensing devices 628A and B. The sensing devices 628A and B may be configured to withstand a shock front of up to 100,000 standard gravities.

The power source module 630 may include one or more power supplies to supply electrical power to the various electrical components included with the sensing device 628A, including but not limited to the sensors, recorder, and processor. The power supplies may include one or more electrical batteries, turbine generators, or any other suitable electrical power supply or generator. The sensor module 640 may include one or more sensors to measure parameters in the wellbore as described herein. The recorder module 650 includes the recorder 504 of FIG. 5 to sample the measured parameters generated from the sensor module 630. The processor module 660 includes the processor 548 of FIG. 5 to analyze the parameter based on the samples acquired by the recorder module 350.

The communication module 670 may include a telemetry device 672, such as a mud-based telemetry device, for transmitting real time data to the earth's surface. The communication module 670 may also include a communication device 674 to facilitate wired or wireless communications. The communication device 674 may include a direct cable connection device to enable a cable to be input into the communication device 674 to transmit and/or upload data. The communication device 674 may also include a wireless communication device, in which the wireless communication device may include, but is not limited to, an inductive coupling unit, a radio-frequency unit, a radio-frequency identification unit, and/or a suitable wireless communication unit (e.g., ZigBee, Bluetooth, UHF, VHF, Wi-Fi, or the like).

Each module 630-670 is easily individually replaceable and integratable with the other modules 630-670. The modules 630-670 may provide a simple assembly and redress procedure that allows for drop-in replacements modules, without re-wiring, re-soldering, or re-potting the components of the sensing device 628A. The modular sensing device 628A provides reduced labor costs in the design and developmental phases as well as in the assembly, maintenance, and redress phases. The modules 630-670 reduce room for human error and the need for frequent and/or extensive maintenance of the sensing device 628A. The elimination of complex and copious wiring within the modules 630-670 may also reduce noise issues frequently seen in the collection of raw data, where post-processing noise filtering methods come with specific disadvantages that add an additional layer of complexity.

The sensing devices 628A and B are also a feed-through devices, which allows the sensing devices 628A and B to be coupled anywhere along a conveyance string and provides feed-through communication paths for one or more cables, including but not limited to a detonation cord 604, power line 605, communication line 607, and an internal communication line 609. The detonation cord 604, for example PRIMACORD® detonating cord available from Ensign-Bickford Aerospace & Defense ("EBAD"), may be employed to convey a controlling ignition to explosive charges included with a perforating gun and cause the charges to detonate, perforating the wellbore as shown in FIG. 3. The power and communication lines 605, 607 may provide an umbilical line for power and communications to various devices, including the sensing device 628A and B, deployed in the wellbore. The internal communication line 609 may provide an internal communication bus to allow data and/or power to be internally transferred among the modules 630-670. For example, the internal communication line 609 may allow for the parameters measured by the sensor module 640 to be transferred to the recorder module 660 for further processing or real-time monitoring and processing at the surface.

As shown, the outer diameter 680 of the sensing devices 628A and B is large enough to allow for the detonation cord 604, power line 605, and/or the communication line 609 to pass through the sensing devices 628A and B. However, any one or combination of the detonation cord 604, power line 605, and communication line 609 may be coupled to the housing 602 to facilitate a smaller outer diameter 680 for the housing 602. When the overall size of the sensing devices 628A or B decreases, material costs are reduced accordingly It should also be appreciated that either of the sensing devices 628A and B may be coupled to a distal end of the conveyance string with a suitable end cap (not shown) attached to the sensing device for bottom-of-string deployment, slickline deployment, or tubing conveyed deployment.

Figure 7:
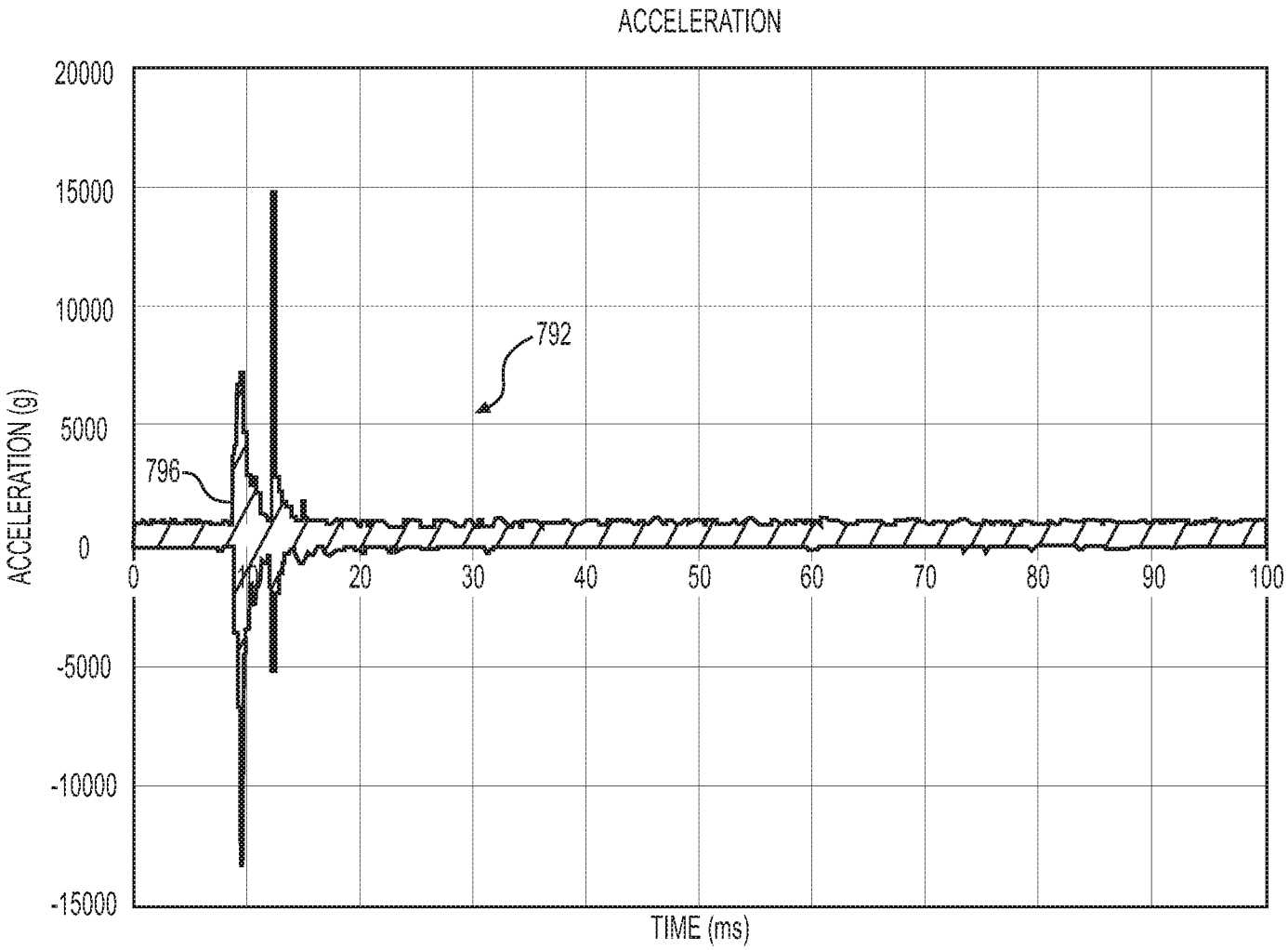
FIGS. 7 and 8 show graph views of a perforating event recorded by the sensing device of FIG. 5, according to one or more embodiments.
Figure 8:
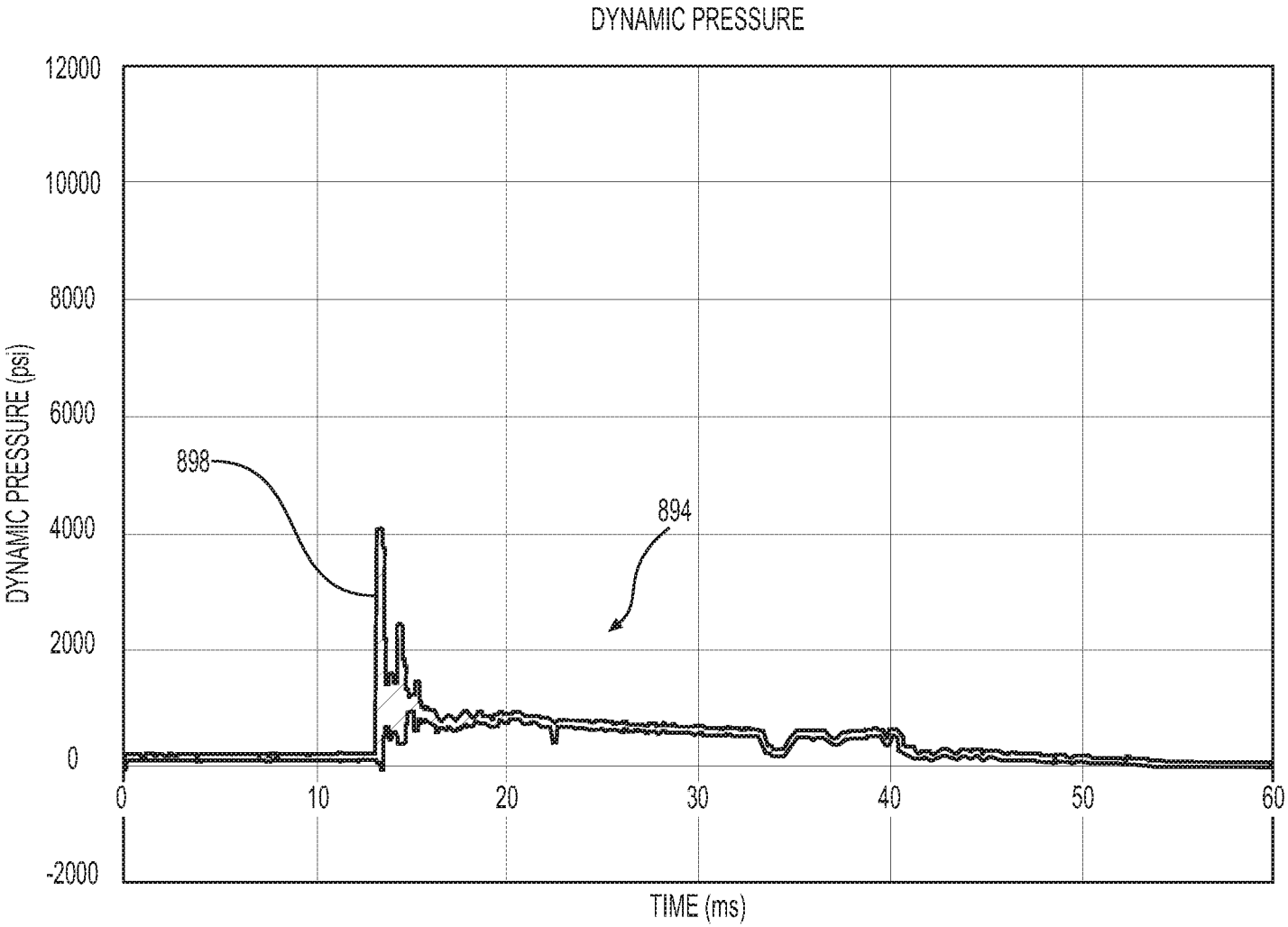

FIGS. 7 and 8 show graph views of a perforating event recorded by the sensing device 528, in accordance with one or more embodiments. Although this discussion is directed to the sensing device 528, it is applicable to the scope of the sensing devices 128, 628A, and 628B as well. During the perforating event, the sensing device 528 recorded samples of pressure and acceleration over time generated from a 2-inch (5 cm) perforating gun deployed in a wellbore. As shown in FIG. 7, the acceleration curve 792 sampled by the sensing device 528 is a function of acceleration (standard gravity, g) over time (milliseconds) with the acceleration scale depicted on the y-axis. The acceleration curve 792 represents the acceleration measured along the x-axis of a Cartesian coordinate system and exhibits two shock events within the first 20 milliseconds of the depicted samples. Although only one acceleration curve 792 is depicted, the sensing device 528 may receive measurements from a tri-axial accelerometer producing acceleration data along the x-, y-, and z-axes. The two shock events may be attributable to the perforating gun experiencing a jump in the wellbore. As shown in FIG. 8, the pressure curve 892 sampled by the sensing device 528 is a function of pressure (psi) over time (milliseconds) with the pressure scale depicted on the y-axis. The pressure curve 894 is filtered to reduce the effects of noise while analyzing the pressure curve 894.

As an example, the processor 548 may analyze the acceleration and pressure curves 792 and 894 in real-time to control operations in the wellbore including but not limited to regulating the pressure in the wellbore in response to detecting a detonation. The sensing device 528 may be operable to identify an event and trigger a command in real-time, such as detecting the detonation and regulating the dynamic wellbore pressure with a surge vent. Detecting the detonation may include detecting the first event attributable to the detonation, such as the first shock front, which is depicted as the impulses 796 and 898 in the curves 792 and 894, respectively. As previously discussed, the slope or a threshold value of the curves 792 and 894 may provide a threshold for triggering an operation by the processor 548.

The sensing device 528 provides wellbore measurement resolution that can verify whether the perforations are successfully formed in the wellbore by monitoring and confirming detonation of each shaped charge and the detonation's orientation as well as initiation of primer cord and successful transfer through the perforating gun string. The measurements can also be used to identify deflagration, low order firing, clean-up, gun orientation, gun jump, gun drop, casing response, and any resulting gas bubbles and the effects of the gas bubbles on the perforating gun string. Assurance of success in the perforating job contributes to the optimization and performance of subsequent operations, including but not limited to, perforating, stimulation, completion, and production. The sensing device 528 also has the capability to autonomously trigger detonations or perform downhole operations in response to identifying a detonation among multiple detonations, which allows for synchronization and/or delays for detonations as data is collected. During a perforating event, the processor 548 may monitor the parameter being sampled with the recorder 504 and control various operations, including but not limited to triggering other detonations, setting latches, releasing baffles, or shifting sleeves, etc., in response to identifying a detonation.

In addition to the embodiments described above, many examples of specific combinations are within the scope of the disclosure, some of which are detailed below:

EXAMPLE 1

A system for monitoring a parameter downhole in a wellbore, comprising:

a conveyance string locatable in the wellbore;

a sensor located on the conveyance string and operable to measure the parameter;

a recorder located on the conveyance string and comprising a sampler in communication with the sensor and operable to sample the measured parameter at a sampling rate of 150 kHz to 10 MHz, and an information storage device in communication with the sampler and operable to store the samples acquired by the sampler; and a processor in communication with the recorder and operable to monitor the parameter based on the samples.

EXAMPLE 2

The system of example 1, further comprising a sensor module comprising the sensor, a recorder module comprising the recorder, and a processor module comprising the processor, wherein the sensor module, the recorder module, and the processor module are coupled together.

EXAMPLE 3

The system of example 1, wherein the processor is operable to analyze the samples to determine any one or combination of an orientation of a detonation in the wellbore, a formation response, a wellbore response, and a casing response to the detonation in the wellbore.

EXAMPLE 4

The system of example 1, wherein the processor is operable to analyze the samples to identify any one or combination of deflagration, high order firing, low order firing, clean-up in a perforation, perforating gun orientation, perforating gun jump, perforating gun drop, and gas bubbles produced from a perforating gun detonation.

EXAMPLE 5

The system of example 1, wherein the parameter includes any one or combination of pressure, temperature, strain, tension, compression, and acceleration.

EXAMPLE 6

The system of example 1, wherein the sampling rate of the sampler is a rate of 1 MHz to 2 Mhz.

EXAMPLE 7

The system of example 1, further comprising a perforating gun located on the conveyance string and operable to detonate a charge in the wellbore.

EXAMPLE 8

A method of monitoring a parameter downhole in a wellbore, comprising:

measuring the parameter using a sensor located in the wellbore;

sampling the measured parameter at a sampling rate of 150 kHz to 10 MHz using a recorder in communication with the sensor; and monitoring the parameter based on the samples using a processor in communication with the recorder.

EXAMPLE 9

The method of example 8, wherein monitoring the parameter further comprises identifying a detonation among detonations fired from a detonation signal from the samples.

EXAMPLE 10

The method of example 9, wherein monitoring the parameter further comprises analyzing the samples to determine any one or combination of an orientation of one of the detonations in a wellbore, a formation response, a wellbore response, and a casing response to the detonations in the wellbore.

EXAMPLE 11

The method of example 9, wherein monitoring the parameter further comprises analyzing the samples to identify any one or combination of deflagration, high order firing, low order firing, clean-up in a perforation, perforating gun orientation, perforating gun jump, perforating gun drop, and gas bubbles produced from a perforating gun detonation.

EXAMPLE 12

The method of example 8, wherein the parameter includes any one or combination of pressure, temperature, strain, tension, compression, and acceleration.

EXAMPLE 13

The method of example 8, wherein the sampling rate is a rate of 1 MHz to 10 MHz.

EXAMPLE 14

The method of example 8, further comprising detonating charges in the wellbore using a perforating gun, wherein monitoring comprises monitoring the detonations based on the samples.

EXAMPLE 15

The method of example 8, further comprising coupling a sensor module comprising the sensor, a recorder module comprising the recorder, and a processor module comprising the processor together.

EXAMPLE 16

A device for monitoring a parameter downhole in a wellbore, comprising:

a sensor locatable in the wellbore and operable to measure the parameter;

a recorder locatable in the wellbore comprising a sampler in communication with the sensor and operable to sample the measured parameter at a sampling rate of 150 kHz to 10 MHz, and an information storage device in communication with the sampler operable to store the samples acquired by the sampler; and a processor in communication with the recorder and operable to monitor the parameter based on the samples.

EXAMPLE 17

The tool of example 16, further comprising a sensor module comprising the sensor, a recorder module comprising the recorder, and a processor module comprising the processor, wherein the sensor module, the recorder module, and the processor module are coupled together.

EXAMPLE 18

The tool of example 16, wherein the processor is operable to analyze the samples to determine any one or combination of an orientation of a detonation in the wellbore, a formation response, wellbore response, and casing response to the detonation in the wellbore.

EXAMPLE 19

The tool of example 16, wherein the processor is operable to analyze the samples to identify any one or combination of deflagration, high order firing, low order firing, clean-up in a perforation, perforating gun orientation, perforating gun jump, perforating gun drop, and gas bubbles produced from a perforating gun detonation.

EXAMPLE 20

The tool of example 16, wherein the parameter includes any one or combination of pressure, temperature, strain, tension, compression, and acceleration.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A system for monitoring a parameter downhole in a wellbore, comprising:

a conveyance string locatable in the wellbore;

a sensor located on the conveyance string and operable to measure the parameter;

a recorder located on the conveyance string and comprising a sampler in communication with the sensor and operable to sample the measured parameter at a sampling rate of 150 kHz to 10 MHz, and an information storage device in communication with the sampler and operable to store the samples acquired by the sampler; and a processor in communication with the recorder and operable to monitor the parameter based on the samples.

2. The system of claim 1, further comprising a sensor module comprising the sensor, a recorder module comprising the recorder, and a processor module comprising the processor, wherein the sensor module, the recorder module, and the processor module are coupled together.

3. The system of claim 1, wherein the processor is operable to analyze the samples to determine any one or combination of an orientation of a detonation in the wellbore, a formation response, a wellbore response, and a casing response to the detonation in the wellbore.

4. The system of claim 1, wherein the processor is operable to analyze the samples to identify any one or combination of deflagration, high order firing, low order firing, clean-up in a perforation, perforating gun orientation, perforating gun jump, perforating gun drop, and gas bubbles produced from a perforating gun detonation.

5. The system of claim 1, wherein the parameter includes any one or combination of pressure, temperature, strain, tension, compression, and acceleration.

6. The system of claim 1, wherein the sampling rate of the sampler is a rate of 1 MHz to 2 MHz.

7. The system of claim 1, further comprising a perforating gun located on the conveyance string and operable to detonate a charge in the wellbore.

8. A method of monitoring a parameter downhole in a wellbore, comprising:

measuring the parameter using a sensor located in the wellbore;

sampling the measured parameter at a sampling rate of 150 kHz to 10 MHz using a recorder in communication with the sensor; and monitoring the parameter based on the samples using a processor in communication with the recorder.

9. The method of claim 8, wherein monitoring the parameter further comprises identifying a detonation among detonations fired from a detonation signal from the samples.

10. The method of claim 9, wherein monitoring the parameter further comprises analyzing the samples to determine any one or combination of an orientation of one of the detonations in a wellbore, a formation response, a wellbore response, and a casing response to the detonations in the wellbore.

11. The method of claim 9, wherein monitoring the parameter further comprises analyzing the samples to identify any one or combination of deflagration, high order firing, low order firing, clean-up in a perforation, perforating gun orientation, perforating gun jump, perforating gun drop, and gas bubbles produced from a perforating gun detonation.

12. The method of claim 8, wherein the parameter includes any one or combination of pressure, temperature, strain, tension, compression, and acceleration.

13. The method of claim 8, wherein the sampling rate is a rate of 1 MHz to 10 MHz.

14. The method of claim 8, further comprising detonating charges in the wellbore using a perforating gun, wherein monitoring comprises monitoring the detonations based on the samples.

15. The method of claim 8, further comprising coupling a sensor module comprising the sensor, a recorder module comprising the recorder, and a processor module comprising the processor together.

16. A device for monitoring a parameter downhole in a wellbore, comprising:

a sensor locatable in the wellbore and operable to measure the parameter;

a recorder locatable in the wellbore comprising a sampler in communication with the sensor and operable to sample the measured parameter at a sampling rate of 150 kHz to 10 MHz, and an information storage device in communication with the sampler operable to store the samples acquired by the sampler; and a processor in communication with the recorder and operable to monitor the parameter based on the samples.

17. The tool of claim 16, further comprising a sensor module comprising the sensor, a recorder module comprising the recorder, and a processor module comprising the processor, wherein the sensor module, the recorder module, and the processor module are coupled together.

18. The tool of claim 16, wherein the processor is operable to analyze the samples to determine any one or combination of an orientation of a detonation in the wellbore, a formation response, wellbore response, and casing response to the detonation in the wellbore.

19. The tool of claim 16, wherein the processor is operable to analyze the samples to identify any one or combination of deflagration, high order firing, low order firing, clean-up in a perforation, perforating gun orientation, perforating gun jump, perforating gun drop, and gas bubbles produced from a perforating gun detonation.

20. The tool of claim 16, wherein the parameter includes any one or combination of pressure, temperature, strain, tension, compression, and acceleration.

* * * * *